US005453002A

United States Patent [19]

Scott

[11] Patent Number: 5,453,002

[45] Date of Patent: Sep. 26, 1995

[54] FUEL SAVING PILOT CONTROL VALVE

[75] Inventor: Jessie C. Scott, Folsom, La.

[73] Assignee: Texaco, Inc., White Plains, N.Y.

[21] Appl. No.: 310,300

[22] Filed: Sep. 22, 1994

[51] Int. Cl.[6] ..... F23Q 9/08

[52] U.S. Cl. ..... 431/6; 431/42

[58] Field of Search ..... 431/6, 46, 42, 431/56, 58

[56] References Cited

U.S. PATENT DOCUMENTS 2,483,298 9/1949 Newman ..... 431/46

2,919,750 1/1960 Cobb ..... 431/46

4,086,048 4/1978 Carlson ..... 431/46

*Primary Examiner*—Carroll B. Dority

*Attorney, Agent, or Firm*—James L. Bailey; Kenneth R. Priem

[57] ABSTRACT

A pilot for a gas fuel burner assembly is controlled so that the pilot is extinguished when the burner is ignited and lit when the burner is extinguished.

4 Claims, 1 Drawing Sheet

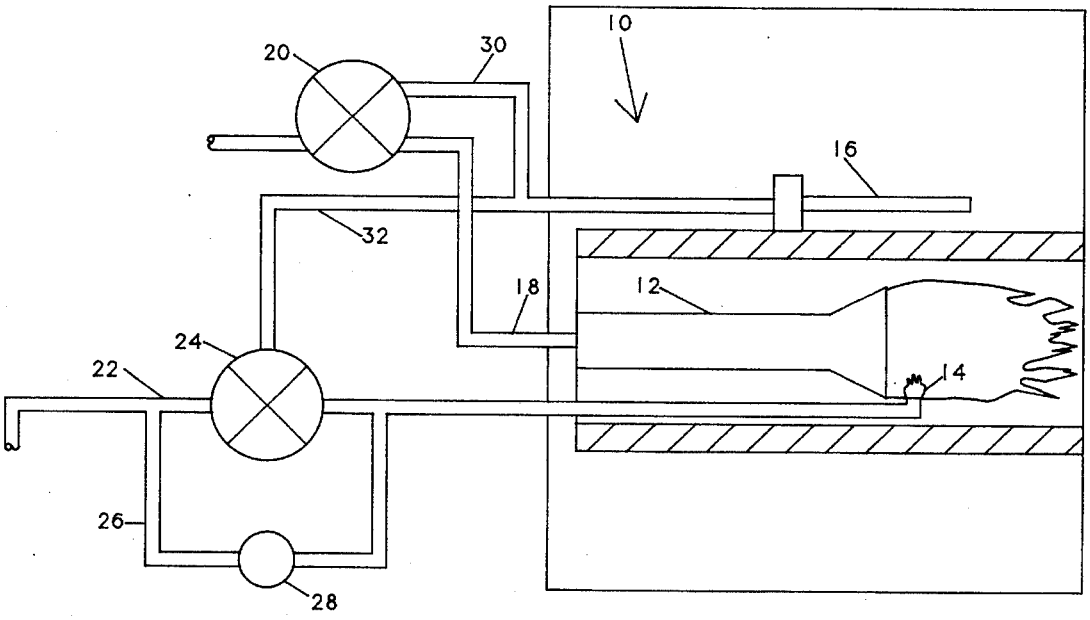
10
20
30
16
32
18
12
24
22
14
26
28

FUEL SAVING PILOT CONTROL VALVE

BACKGROUND OF THE INVENTION

1. The Field of the Invention

The present invention relates to a method and apparatus for saving fuel by controlling the pilot valve of a burner assembly so that the pilot valve does not operate while the primary burner is functioning.

2. The Prior Art

It is quite common in gas burners of substantially any type to have a pilot valve for igniting the main burner. Heretofore it has been the common practice to allow the pilot to burn continuously whether or not the primary burner is lit. The operation of the pilot while the primary burner is ignited is a redundancy.

The present invention has an object to overcome the previous redundancy by providing a method and apparatus whereby the pilot will be ignited only at such times as when the main or primary burner is not ignited.

SUMMARY OF THE INVENTION

The present invention concerns a method and apparatus which will control a pilot light to burn only when it is absolutely necessary, namely when the primary burner is not ignited, thereby saving fuel gas that would normally be consumed unnecessarily.

BRIEF DESCRIPTION OF THE DRAWINGS

The present invention will now be described, by way of example, with reference to the accompanying drawings in which the single FIGURE is a schematic representation of a fuel gas pilot control valve system according to the present invention.

DETAILED DESCRIPTION OF THE PRESENT INVENTION

The drawing illustrates a burner assembly 10 having a primary burner 12, a pilot light 14 and a main burner temperature control 16. Pipe 18 connects the main burner 12 to a fuel supply (not shown) through a normally closed main burner fuel control valve 20. The pilot light 14 is connected to the same fuel gas source through pipe 22 having therein a normally open valve 24 with pipe 26 and bypass valve 28 forming a bypass for the valve 24. The main burner temperature control 16 is of a known type and is connected to the main burner control valve 20 by pipe 30 and to the pilot light control valve 24 by pipe 32. The bypass valve 28 would be open for startup only and it would be closed after the main burner 12 is lit. The rising temperature of the media from the main burner 12 is sensing by the temperature control 16, decreases the output to the main burner control and thus lowers the main burner flame. This simultaneously decreases the output also opening the pilot valve 24 to ignite the pilot light 14 completing the process.

The present invention may be subject to many modifications and changes without departing from the spirit or essential characteristics thereof. The present embodiment should therefore be considered in all respects as illustrative and not restrictive as to the scope of the invention as defined by the appended claims.

I claim:

1. A method for controlling both the main burner and pilot light of a burner assembly comprising:

providing a main burner connected to a fuel supply through a main burner control valve;

providing a pilot light connected to said fuel supply through a pilot light control valve;

providing main burner temperature control means;

monitoring the main burner flame with said temperature control means and controlling both said control valves so that when the main burner control valve is open said pilot burner control valve is closed and vice-versa.

2. A method according to claim 1 further comprising:

bypass means including a bypass valve connected across said pilot light control valve;

actuating said bypass control valve during ignition of said burner assembly.

3. A system for controlling a pilot light of a burner assembly comprising:

a burner assembly having a primary burner;

a pilot light associated with said primary burner;

first pipe means connecting primary burner to a fuel gas source and containing a control valve therein;

second pipe means connecting said pilot valve to said source of fuel gas and containing a second control valve therein;

main burner temperature control means having temperature sensing means operatively positioned with respect to the flame of said main burner and connected to actuate said first and second control valves in response to the sensed temperature whereby the main burner is lit the pilot valve is closed and when said main burner is extinguished said pilot valve is open.

4. A system according to claim 3 further comprising bypass means including a bypass pipe and bypass valve expanding said pilot control valve whereby said valve can be bypassed during initial ignition of said burner assembly.

* * * * *